US008080305B2

(12) United States Patent
Biondi et al.

(10) Patent No.: US 8,080,305 B2
(45) Date of Patent: Dec. 20, 2011

(54) PRODUCT TRANSFERABLE BY DECALCOMANIA

(75) Inventors: Giuseppe Biondi, Termoli (IT); Donato Rondini, Termoli (IT)

(73) Assignee: Shock Line S.r.l., Termoli (IT)

( * ) Notice: Subject to any disclaimer, the term of this patent is extended or adjusted under 35 U.S.C. 154(b) by 1068 days.

(21) Appl. No.: 11/816,511

(22) PCT Filed: Feb. 17, 2006

(86) PCT No.: PCT/IT2006/000085

§ 371 (c)(1),
(2), (4) Date: Aug. 16, 2007

(87) PCT Pub. No.: WO2006/087757

PCT Pub. Date: Aug. 24, 2006

(65) Prior Publication Data

US 2008/0152797 A1 Jun. 26, 2008

(30) Foreign Application Priority Data

Feb. 18, 2005 (IT) ..... RM2005A0074

(51) Int. Cl.
*B41M 5/00* (2006.01)
*B44C 1/17* (2006.01)
*G03G 7/00* (2006.01)

(52) U.S. Cl. ..... 428/195.1; 428/202; 428/914

(58) Field of Classification Search ..... 428/195.1, 428/202, 914; 427/147, 149
See application file for complete search history.

(56) References Cited

U.S. PATENT DOCUMENTS

| | | | | |
|---|---|---|---|---|
| 3,510,385 | A | 5/1970 | Lythgoe et al. | |
| 3,533,822 | A | 10/1970 | Bailey | |
| 3,669,704 | A | 6/1972 | Reiling | |
| 5,229,201 | A | 7/1993 | Blanco | |
| 5,328,535 | A | 7/1994 | Blanco | |
| 5,876,547 | A * | 3/1999 | Kiesow et al. | 156/215 |
| 6,309,734 | B1 | 10/2001 | Taniguchi et al. | |
| 6,428,647 | B1 | 8/2002 | Koh et al. | |
| 2003/0068477 | A1 * | 4/2003 | Nakanishi et al. | 428/195 |

FOREIGN PATENT DOCUMENTS

| | | | |
|---|---|---|---|
| EP | 0937584 | A2 | 8/1999 |
| EP | 1457513 | A1 | 9/2004 |
| EP | 1498285 | A2 | 1/2005 |
| GB | 793391 | A | 4/1958 |
| GB | 2025849 | A | 1/1980 |
| JP | 2004004212 | A | 1/2004 |
| WO | 9742040 | A1 | 11/1997 |

* cited by examiner

*Primary Examiner* — Mark Ruthkosky
*Assistant Examiner* — David J Joy
(74) *Attorney, Agent, or Firm* — Volpe and Koenig, P.C.

(57) ABSTRACT

A mixture used for production of decalcomania transferable products, the production and application of the transferable products by the utilization of a transfer solvent is provided. The mixture includes 1 to 40 percent by weight of a dispersant and stabilizer for organic materials, soluble in the transfer solvent (z); and at least one of: 3 to 95 percent by weight of a polymer or copolymer printable by a solvent based ink plotter (x), and 1 to 90 percent by weight of an organic raw material which is adhesive if soaked and which is soluble in the transfer solvent (w). The percentages z, x, w selected such that $z+x+w \leqq 100$ and at least 15% of the components are soluble in the transfer solvent. A product transferable by decalcomania; a manufacturing process for the decalcomania product; and a process for its application are also presented.

21 Claims, 1 Drawing Sheet

PRODUCT TRANSFERABLE BY DECALCOMANIA

FIELD OF INVENTION

This invention concerns a mixture to be used in the production of transferable products for decalcomania, a product transferable by decalcomania, the process to produce it and the decalcomania process wherein such transferable product can be used.

More particularly, the invention concerns a mixture to be used in the production of a water transferable product for absorbing surfaces. The transferable product includes one or more layers of the mixture according to this invention and can be printed by a digital printing technique by means of a solvent based so-called "print plotter". The invention also concerns not only the process for production of the transferable product, but also a process for its application, for instance to walls, natural wood or any absorbing surface, of natural and synthetic material including nap surfaces.

The field of the invention is the one of decoration, or more generally, the ones of graphics and communications, in relevant relationship with the field of fine arts.

BACKGROUND

There are many conventional ways to obtain a customized image on a wall (or other kind of surface): in addition to manual painting, such as fresco or other techniques, wall-papers or films exist with various colours and patterns, Greek frets in wall paper and films, decalcomania transferable products as well as pre-printed decorations, all produced by conventional graphic arts techniques and as such unable to be furnished under specific request, but only selectable among an available pattern inventory. Moreover, the application of such papers exhibits a visual effect far away from the one corresponding to fresco.

If, on the other hand, we look at traditional digital approaches utilizing digital technologies, which appear to be the only way to have exclusive designs on request, the offer today consists in the possibility to print directly on walls by means of a very cumbersome special device so-called "printing plotter" which works vertically (hereinafter such a "printing plotter" will also be simply referred to as a "plotter").

Normally this technique is used for the decoration of scaffoldings during restorations of churches or other monuments or in advertising signs. Obviously, the use of this device is very difficult and expensive and the printing resolution is rather low (it is only suitable for long distance communications, for example in the advertising boards).

There are also special kinds of wall-papers and wall-films which can be printed by means of a digital device, for example with a water-based ink plotter (scarcely resistant and therefore only suitable for advertising) or with solvent based ink plotters (improved resistance). The result is obviously a paper or a film attached to the wall and, even if beautiful and well camouflaged (there are papers and films with embossed surfaces similar to mural paintings), it remains similar to an adhesive.

Moreover, the mostly advertised product nowadays, and with the best aesthetical results, is a 3M® system, based on a printable film for electrostatic plotter, and used by 3M® customer partners with qualified personal. 3M® partners supply the finished decoration, rather than the printed paper to be applied, since the application technique is very complex.

Anyway this is the most interesting possibility, since in some aspects it is the closest one to the approach as proposed by the present invention.

The 3M® system provides for the use of a special paper printable by an electrostatic plotter, or a paper used for the ceramic transfers. In the proposed method this paper must be printed by means of an electrostatic plotter.

The electrostatic plotter is a less common device and more expensive in the management than the ink jet plotter. Moreover this device utilizes inks in a powdery form, similar to toners for laser printers, and so walls will hardly absorb them; anyway, with suitable treatments it is possible to give to the final result an aspect more similar to the fresco than that obtainable with the other above described systems.

This result, however, in addition to the fact that it is not optimum as yet, is obtainable only with a considerable technical and economical stress, since the intervention of qualified personnel is absolutely necessary for the application. This makes an autonomous application by the customer impossible.

Among the existing patent documents relating to decalcomania products, the following have to be mentioned in this description.

Documents U.S. Pat. No. 5,229,201 and U.S. Pat. No. 5,328,535, describe a multilayer decalcomania product including a backing sheet having applied thereon in the quoted order a first water soluble layer, a first coating layer, an image layer including a pigment arranged on said first coating layer, and a second coating layer arranged on the image layer. The second coating layer protects the design during the application on the porous surface. The first water soluble layer can be made of dextrin.

During the application, a bonding agent is firstly applied on the porous surface. Preferably this binder includes a fast acting solvent component such as for instance an alcohol, an ether, an aromatic hydrocarbon or an ester; a moderating agent such as for example a polyhydroxy compound; and a thickening agent, such as a polyvinyl alcohol or cellulose. In the next step, the backing layer is removed by applying water to said decalcomania product and then this is applied without the backing layer to the connective agent layer, directly on the side of the first coating layer.

It can be observed that the application of such a decalcomania product requires a surface pre-treatment.

Document U.S. Pat. No. 3,510,385 describes a decalcomania product such that, after its application, the image can be modified on the substrate surface by means of an in situ treatment.

The decalcomania product is made up of a backing layer and several transferable layers. The upper layer is an adhesive layer (preferably a pressure-sensitive adhesive layer) and is not soluble or dispersable in water, while the inner layer, on the contrary, due to its composition, is soluble or dispersable in an aqueous medium. It is important that in the decalcomania product's composition there is at least one layer on which the aqueous medium cannot have any effect. In the case of two layers, the one placed directly on the support is a water soluble layer and the following one is a non water soluble and adhesive layer (preferably a pressure sensitive adhesive layer). The pigment is arranged in some areas of the soluble layer, so that, after the application of the decalcomania product on the substrate, the soluble layer or a portion thereof may be removed by water, making the pigment appear. In the case of a multi-layer version, it is possible to repeat this step several times, so as to obtain every time a different image on the substrate.

It is clear that this decalcomania product cannot be printed by the final user, but it is to be decorated before applying the last functional layer, namely the adhesive one, whereby it is to be considered among those decalcomania products that restrict the selection of the image to the ones furnished by the manufacturer.

Document WO 97/42040 describes a decalcomania product made up of several layers, these are in order: a water permeable support with a release layer formed of a water releasable adhesive on its surface, eventually a barrier layer and an image layer printable by means of ink jet printer. In a particular application, the support is peeled away after the transfer has been applied to walls, the image layer after having coated it with a binding agent, as in the case of the preceding document.

Anyway it is not possible to produce the transfer following the instructions described in the document, so this simply remains a description of a good idea.

Document U.S. Pat. No. 3,533,822 describes a transfer particularly for ceramic surfaces, made up of a support on which layers are placed as follows: a release layer, an optional barrier layer, a pattern or image layer and an adhesive layer. After the application of the transfer on a surface, the support is removed by dampening it with water. In the document we can find the composition of the release layer, which is made of at least an ester of polyethylene glycol selected from polyethylene glycol monolaurates, polyethylene glycol stearates, polyethylene glycol oleates. The one described in this last document is a common transfer and needs an adhesive layer on the image layer.

Document JP2004004212 introduces a product built of a pad layer and a transfer layer, laminated subsequently on the surface of a base material. A release layer is placed on the back side of the base material.

The transfer layer is a coating obtained by spreading a mixture of polyvinyl alcohol, an hydrorepellent resins and a solvent on the base material, and it has a superficial roughness of 1-20 μm. The pad layer includes a soft polymeric resin having shock absorbing properties. The transfer layer can be printed with an electro-photographic device and can transfer the image to a target transfer substrate. The advantage of this kind of transfer is that it is possible to repeatedly print faint images by toner to target transfer substrate. In the preferred embodiment, a soaking layer containing a polymeric resin adapted to prevent the base material from absorbing water is interposed between the pad layer and base material, it is aimed at maintaining the smoothness transfer layer as a result of the strength of the interlayer bond. The preferred polymeric resins contained in the pad layer is a urethane resin having an elasticity figure of 500-1500%, as measurable with JIS K 7127. The release layer is made of a silicone resin. The preferred solvent is a butyl-cellosolve.

This decalcomania product needs a pad layer and a further layer arranged on the back of the support base material.

Document EP 1457513 describes a mixture, which can be also used to obtain a decalcomania product, comprising one or more isostatic modified polypropylenes (MPP) or a polypropylene-a-olefin copolymer, and one or more polymers or resins, wherein said MPP or MPP copolymer is modified with one or more carboxy, anhydride, hydroxy or epoxy groups.

Document GB793,391 discloses a decalcomania or transfer material of the type comprising a water-permeable backing, such as porous water-leaf paper, an adhesive layer, and a sizing layer intermediate the backing and adhesive. A lacquer coating may be applied over the adhesive coating or the printing may be applied directly to the adhesive coating. To transfer the print the paper is soaked in water until the adhesive coating is softened sufficiently to permit the print to be slipped off, after which the print is mounted on the article to be decorated. At least part of the adhesive layer is transferred with the separable layer to stick the transfer to the surface to which it is to be applied.

The sizing layer is provided to resist to curling during printing and applying the decalcomania.

The adhesive layer comprises a bottom gumming and a top gumming layers. Top gumming, which is the printable layer, is preferably made of dextrin, which may be mixed with animal glue, resin dispersions, wetting agent and a plasticiser such as glycerine and sorbitol.

Finally, document EP 1498285 discloses a decalcomania product which consists of a water-permeable and water soaking resistant support, preferably a paper or a fabric sheet with short fibers, which is covered by a first layer or "coat" of a water resistant material at room temperature, made of one or more substances of mineral, animal or vegetable origin and preferably selected from the group comprising gelatins, alginates, starches, dextrin, methylcellulose, ethylcellulose, carboxymethylcellulose, urea resins, phenolic resins, arabic gum and tragacanth gum, a second layer spread on the first layer, made of one or more transparent synthetic and water-permeable resins, which are water or other solvent soluble and are preferably selected from the group comprising vinyl, acrylic, epoxy and polyurethane resins, a waterproof decoration being printed on said second layer which has to be transferred onto a generic surface. The decoration can be printed by exploiting the common technologies, such as offset, rotogravure, serigraphy, flexography, typography print or by computerized print by means of printer or plotter. The support, the coat and the synthetic resin are bonded to one another without any inter-penetration, and the decalcomania product can be micro-punctured before or after printing the decoration onto the second layer.

In this decalcomania product, the first layer or "coat" on the support is water resistant at room temperature, water being needed for releasing the support member after application. This means that the decalcomania product needs a water soluble, synthetic adhesive resin layer to be spread on the surface to be decorated.

Some of the transferable products as described in the above cited documents have the same above mentioned problems, namely the need of a pre-treatment of the application surface or the need a special additional layers, all of which make the manufacturing expensive, and in addition they turn out to be technically impossible to realise and complex, and expensive to be manufactured and/or applied.

SUMMARY

It is an object of this invention to supply a mixture to be used for the production of a transferable decalcomania product printable with a solvent-based ink plotter.

It is a further specific object of the present invention to supply a transfer product that can be used without the problems that affect the prior art decalcomania products.

Another specific object of this invention is to suggest a process for production of the transfer product which is the first object of this invention.

Another specific object of this invention is to suggest an application process for the transfer product which is the first object of the present invention.

Subject matter of the present invention is a mixture to be used for production of decalcomania transfer products, the production and the application of said transfer products taking place under utilisation of a transfer solvent, said mixture being in that it comprises a component consisting of:

a z by weight percentage, in the range of 1 to 40, of a dispersant and stabilizer for organic compounds, soluble in the transfer solvent, and at least one of the two following components:

a x by weight percentage, in the range of 3 to 95, of a polymer or copolymer printable by a solvent-based ink plotter, a w by weight percentage, in the range of 1 to 90, of an organic compound which is adhesive if soaked and which is soluble in said transfer solvent, the percentages z, x, w being selected in such a way that $z+x+w \leqq 100$ and at least 15% of the components being soluble in the transfer solvent.

In accordance with this invention, the mixture can also contain the following component:

a y by weight percentage, in the range of 3 to 80, of an adhesion promoter, the percentages z, x, w, y being selected in such a way that $z+x+w+y \leqq 100$ and at least 15% of the components being soluble in said transfer solvent.

In accordance with this invention, the mixture can contain both said polymer or copolymer and said organic material which can become adhesive if soaked.

In a preferable embodiment of the invention, said dispersant and stabiliser for organic material is a dispersant and stabiliser for polymers or vinyl copolymers.

Preferably, in accordance with this invention, said dispersant and stabiliser for organic material is selected from the group comprising polyvinyl alcohols, water-soluble compounds of cellulose, surfactants, polyvinylpyrrolidones.

Preferably, in accordance with this invention, said dispersant and stabiliser for organic material is a polyvinyl alcohol.

Preferably, in accordance with this invention, said polyvinyl alcohol has a weight average molecular weight in the range of 31000 to 124000 uma and a hydrolysis figure not higher than 90 percent, more preferably a weight average molecular weight in the range of 85000 to 124000 uma and a hydrolysis figure in the range of 87 to 89 percent.

Preferably in accordance with this invention, said z percentage is between 1 and 20, more preferably between 1 and 12 percent.

Preferably in accordance with this invention, said polymer or copolymer is a vinyl polymer or copolymer.

Preferably in accordance with this invention, said vinyl polymer or copolymer is selected among ethylene vinyl acetate, ethylene vinyl chloride, polyvinyl acetate, copolymers of ethylene with vinyl acetate, copolymers of ethylene with vinyl chloride, copolymers of ethylene with the styrene, chlorinated or fluorinated vinyl copolymers.

Preferably, in accordance with this invention, said x percentage is between 6 and 90, even more preferably between 25 and 80.

Preferably, in accordance with this invention, said organic raw material which can become adhesive if soaked is selected among the following group of compounds: soluble polysaccharides, casein, albumin, fish glue.

Preferably, in accordance with this invention, said w by weight percentage is between 1 and 85, more preferably between 1 and 80.

Preferably, in accordance with this invention, said adhesion promoter is a polymer, even more preferably a polyvinylacetate.

Preferably, in accordance with this invention, said y percentage is between 3 and 50, even more preferably between 10 and 40.

Preferably in accordance with this invention, said transfer solvent is selected from the following group of compounds: water, mixture of water and alcohol, mixture of water and acids, alcohols without water, glycols, ester, ethyl acetate.

A further specific object of the present invention is a decalcomania product in that it comprises a support on which at least one layer of the mixture according to this invention is applied, wherein the farthest layer from said support being a layer that can be printed by means of a solvent based ink plotter.

Preferably, in accordance with this invention, at least two layers of said mixture are applied on said support, the layer directly contacting the support, or release layer, having a solid content that is more soluble in said transfer solvent than the layer farther from the support, or printable layer.

Advantageously, in accordance with this invention, two layers of said mixture are applied on said support, the release layer and the printable layer.

Preferably, in accordance with this invention, the printable layer comprises said polymer or copolymer and said dispersant and stabiliser for organic material.

Preferably, in accordance with this invention, said printable layer is made of the mixture according to this invention, comprising both said polymer or copolymer and said dispersant and stabiliser for organic material and said organic raw material which can become adhesive if soaked, the weight percentage w being in the range of 1 to 40, more preferably in the range of 10 to 40, most preferably in the range of 30 to 40.

Preferably, in accordance with this invention, the release layer comprises both said dispersant and stabiliser for organic material and said organic raw material which can become adhesive if soaked. Preferably, in accordance with this invention, the minimum total content of substances soluble with said transfer solvent in said release layer is of 20%.

Preferably, in accordance with this invention, said w percentage is between 5 and 90, more preferably between 10 and 85, and even more preferably between 25 and 80.

Preferably, in accordance with this invention said z percentage is between 3 and 40, more preferably between 5 and 20.

Preferably, in accordance with this invention, said y percentage is between 3 and 50, more preferably between 30 and 50.

Preferably, in accordance with this invention, said x percentage is between 0 and 20, more preferably between 0 and 10.

Advantageously, in accordance with this invention, the total thickness of said at least one layer is between 5 and 80 μm.

Advantageously, in accordance with this invention, in the decalcomania product according to this invention with at least two layers, the thickness of the printable layer is between 3 and 40 μm and the thickness of the release layer is between 2 and 40 μm.

Advantageously, in accordance with this invention, the total thickness of said at least one layer is between 7 and 40 μm.

Advantageously, in accordance with this invention, in the decalcomania product according to the invention with at least two layers, the thickness of the printable layer is between 5 and 20 μm and the thickness of the release layer is between 2 and 20 μm.

Advantageously, in accordance with this invention, the total thickness of said at least one layer is between 10 and 24 μm.

Advantageously, in accordance with this invention, in the decalcomania product according to the invention with at least two layers, the thickness of the printable layer is between 8 and 16 μm and the thickness of the release layer is in the range between 2 and 12 μm.

Preferably, in accordance with this invention, said support is made of a material permeable to said transfer solvent but resistant to disaggregation due to soaking.

Preferably, in accordance with this invention, said support is made of paper material.

Preferably, according to this invention, said support is made of a filter paper.

Preferably, according to this invention, said support is a support of paper material, more preferably a filter paper or a silicone and/or polythene coated paper.

Preferably, in accordance with this invention, said support is built of nonwoven fabric suitably modified so as to be permeable to said transfer solvent.

Preferably, in accordance with this invention, said nonwoven fabric is made of natural fibers.

Preferably, in accordance with this invention, said nonwoven fabric is made of synthetic fibers.

Preferably, in accordance with this invention, said nonwoven fabric is made of natural and synthetic fibers in combination.

Preferably, in accordance with this invention, said support is made by a nonwoven fabric consisting of polyester, cellulose and viscose fibers combined together by means of a binder.

Preferably, in accordance with this invention, said support is built of nonwoven fabric (NWF) suitably modified so as to be permeable to said transfer solvent.

Preferably, in accordance with this invention, said nonwoven fabric is permeable to water.

Preferably, in accordance with this invention, said nonwoven fabric is selected among those utilised in the production and preservation of foods or for filtering fluids, for instance in depuration of water or air streams, and of liquid foodstuffs, such as milk.

Preferably, in accordance with this invention, said nonwoven fabric is selected among those utilised for manufacture of the small bags as used in infusion processes, for example tea bags or as filters for milk.

Preferably, in accordance with this invention, the nonwoven fabric has a basic weight between 10 and 100 g/m$^2$.

Preferably, in accordance with this invention, the basic weight of this nonwoven fabric is between 10 and 90 g/m$^2$, and even more preferably between 10 and 60 g/m$^2$.

Advantageously, in accordance with this invention, the nonwoven fabric is made of mixed polyester, viscose and cellulose fibers combined together by means of a binder and it is not subject to remarkable dimension variation when it is soaked with water. An example of this kind of nonwoven fabric is the Tamlon Nonwoven k 314 29, manufactured by Ahlmstrom.

Advantageously, in accordance with this invention, the printable layer is protected by a plasticized removable paper.

It is still specific subject-matter of this present invention a process for production of the transfer product according to this invention, characterized from the following successive steps:

A. applying said at least two layers successively, in reverse order with respect to said transferable product, on a temporary support;

B. passing said temporary support bearing said two layers applied according to said step A. through a calender together with the support of said transferable product, so that said release layer adheres to said support of said transferable product; and C. as soon as the product as obtained in step B. is returned to room temperature or before the printing operation designed to realise the image to be transferred, removing the temporary support simply by mechanical means.

Preferably, in accordance with this invention, the application (spreading) of said mixture is carried out by using said transfer solvent, in particular water as a carrier.

Preferably, in accordance with this invention, the calendering process of step B. is carried out by a hot cylinder or in wet condition.

Preferably, in accordance with this invention, during the calendering process the cylinder temperature is in the range of 80 to 115° C.

Preferably, in accordance with this invention, during the calendering process, the pressure on the product is in the range of $2\cdot10^5$ to $4\cdot10^5$ Pascal, with a cylinder tangential velocity set between 0,008 and 0.05 m/s, more preferably its temperature is set between 90 and 105° C.

Advantageously, in accordance with this invention, during the calendering process the cylinder temperature is set between 20 and 60° C. (if in wet conditions). Before this calendering step, it is possible to softly dry the lastly spread coating so as to have a little moisture residual content designed to aid the wet transfer procedure (in the thermal case, it is possible to carry out a complete drying step). Subsequently, the composite consisting of the temporary support, the coatings and the support of the transferable product (in the preferred embodiment the nonwoven fabric) will be dried by warm air.

Advantageously, in accordance with this invention, the adhesion surface of said temporary support is a smooth, not absorbent surface which is resistant to the adhesion of thermoplastic polymers.

Preferably in accordance with this invention, said temporary support is a paper selected among the silicone treated paper, coated paper, polythene treated paper, coated and silicone treated paper.

It is a further specific object of the present invention to provide a decalcomania application procedure wherein the transferable product according to this invention is used, characterized in that it includes the following steps:

E. printing the desired image on the surface of the transferable product, waiting for the ink to be dry, placing the transferable product with its printable layer against the substrate surface;

F. substantially uniformly soaking said transferable product (on its the back surface, namely on the support side) with said transfer solvent;

G. waiting for a time at least sufficient to dry the back surface of said transferable product soaked in accordance with the F. step;

H. again substantially uniformly soaking the transferable product (on its back surface, namely on the support side) with said transfer solvent;

I. removing the support of said transferable product by simply pulling it away.

In accordance with this invention, when the transferable product is a product according to this invention, the application procedure can include a preliminary step Z., to be carried out before step E., consisting in removing the removable plastified paper.

Advantageously in accordance with this invention, in the G. step, the waiting time is of at least 2 hours, still more advantageously at least 24 hours.

In accordance with this invention, the application procedure can include a further step L., to be carried out after step I., consisting in spreading one or more substances containing a crosslinking agent which can crosslink the row materials forming the layer transferred to the wall, or, more generally, a protective agent on the transferred product.

In accordance with this invention, the application procedure can include a further preliminary step M., to be carried out before step E., consisting in the application of an adhesion and absorption promoter on the surface of the substrate to be decorated.

BRIEF DESCRIPTION OF THE DRAWINGS

This invention will be now described by way of illustration and not by way of limitation by particularly referring to the attached drawings, wherein.

DETAILED DESCRIPTION OF THE PREFERRED EMBODIMENTS

Figure 1:
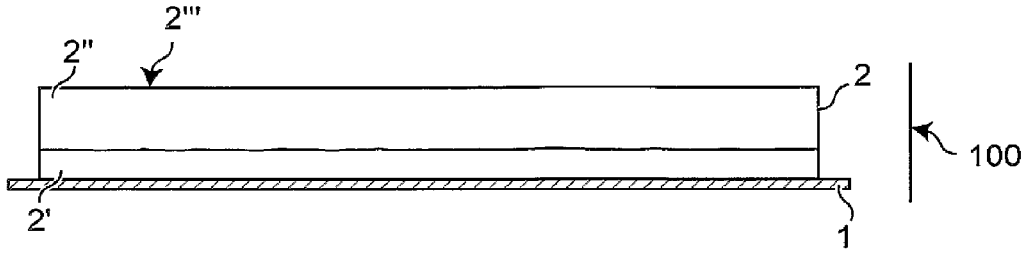
FIG. 1 shows a first preferred embodiment of the product in accordance with this invention.

The present invention concerns a directly printable transferable product, in particular by means of a solvent based ink plotter, preferably operating according to an ink jet technology, which is easily applicable also by a customer without any sectorial knowledge, in order to decorate walls with smooth or rough surfaces or more broadly all kinds of solvent absorbent substrates, in particular water absorbent substrates, including all substrates with nap surfaces.

More in detail, the transferable product in accordance with this invention is printable by means of a plotter which utilizes a solvent/ecosolvent based ink and the application is carried out by absorption in the substrate of a polymeric coating temporarily supported by a paper or preferably by a nonwoven fabric. The paper should be resistant to soaking and preferably consisting of natural and short fibers, more preferably replaced by a nonwoven fabric, for example those used for making the tea bags.

The polymeric coating in accordance to this invention is soluble in said transfer solvent and has been specifically designed to be applicable, thanks to such solubility, on absorbent (porous) substrates without jeopardizing the photographic definition of the image printed during the application.

The principle used for developing the invention and the related application process is to obtain a coating or "carrier" that can be disaggregated as a consequence of the solubilisation effect by the transfer solvent that cannot attack the pigments of the image. A transfer solvent of this kind can be selected among the following: first of all, water, alcohols, a mixture of water and alcohols or water and acids, glycols, esters (such as ethyl acetate).

Among the above listed solvents, water is the most readily available, the least expensive and the most harmless to use, in view of these reasons we will consider hereinafter only water. Nevertheless, it should be understood that it is possible to use any other kind of solvent adapted to fulfill the same requirements.

Upon disaggregation of the carrier, its soluble components are absorbed by the substrate together with water and facilitate the diffusion of the unsoluble components and of the ink pigments therein.

The use of polymers or copolymers which are soluble or dispersible in water, particularly in the form of resins, in order to apply (to spread) a coating that can be printed by means of a solvent based ink is an essential feature of this invention.

Normally this principle is exploited for prints obtained by means of an ink jet plotter where use is made of water based inks. The resin begins dissolving and absorbs the ink.

When it is desired to use water for the application of the transferable product, so as to make the application itself extremely easy, effective and quick, a not water resistant ink would be too difficult to be transferred because it would be dispersed in the aqueous solution utilised for the transfer operation.

The use of water soluble or dispersible resins in combination with water resistant inks is an important feature of the transferable product according to this invention, that, therefore, can be very easily applied without burrs and defects.

With reference to the FIG. 1, it can be observed that a preferred embodiment of the invention includes a transferable product 100 made of a support 1 on which a printable layer 2, or the above mentioned polymeric coating or carrier is applied.

The simple filtering support 1 on which the polymeric coating is spread, even if commonly utilised, has already been used to produce decalcomania products for walls, but it has never been used in digital printing. Such support can be replaced for example with simple papers, absorbent papers, soaking resistant papers, silicone based papers, and like, fabrics of various kinds, canvas. It is essential that the chosen support is water-permeable and soaking resistant.

As far as the broad composition of the polymeric coating is concerned, for the purposes of this invention, it should be re-wettable, namely re-water-soluble. For instance it is possible to use the same glue as used in stamps suitably mixed with other resins.

The transferable product as shown in FIG. 1 is printable on the polymeric coating 2 (surface 2''') and it is applicable on wet porous surfaces, for example with a wet roll. Upon drying the polymeric coating 2, a portion 2'' thereof penetrates into the porous surface. After a sufficient time delay to ensure such absorption, the product can be wetted again and this will cause the separation of the support 1 (possibly together the layer 2' of the polymeric coating 2) without damaging said absorbed coating 2 (or its layer 2'').

The polymeric coating, whose composition will be described below, solves per se the problem unresolved in the prior art, without any special treatment of the wall or of the transferable product itself.

However, it is clear that, depending on the circumstances, some of such treatments can be used to merely improve the result, for example the use of an adhesion and imbibition promoter, a solvent for accelerate the penetration in the substrate, catalysts and cross-linking agents, fixing acids, or protective agents used in specific applications described below.

It is possible to use the cross-linking agent, for example, to increase the resistance of the fresco to aging, by exploiting the hardening the polymeric coating as obtained by cross-linking the polymeric chains forming its structure.

The protective agent, instead, could be replaced by a film forming transparent substance that, upon being spread on the finished fresco, protects it from the damages due to ultraviolet rays, to rain or to other degenerative agents.

It is clear, however, that the use of such treatments is different from case to case, and anyway the use of cross-linking and/or protective agents should take place in the right stage during the application of the transferable product according to this invention. In fact, said cross-linking agent increases the resistance of the compound or of the mixture to which it is applied to solvents, and, if it is used before the adhesion of the transferable product to the substrate, it could also at least partially jeopardize the specific properties of the product and it would also be possible to have a bad absorption of the layer thereby making its penetration into the substrate worse and/or causing a bad removal of the support.

It is also possible to utilize an adhesion and absorption promoter for the coating into the substrate to be decorated.

Some broad and not restrictive examples of such treatment are silicate bases for mural varnishes or suspensions of vinyl polymers and silicas in water or other kind of solvent.

The printable coating is, for example, preferably made of:

- a raw material printable with solvent based inks, in concentration between 5 and 95%, more preferably between 10 and 90%, still more preferably between 25 and 80%, which can be a natural or synthetic polymer, such as for example: ethylene-vinyl acetate, ethylene-vinyl chloride and other vinyl polymers and copolymers. In particular ethylene-vinyl acetate has been used with a glass transition temperature of 5° C. (DSC) and elongation at break of the 700%;
- a raw material that becomes adhesive if wetted and completely soluble in water (so-called resoluble material) that leaves no residual in the percentage between 1 and 40%, more preferably between 10 and 40%, still more preferably between 30 and 40%, for example a polysaccharide soluble in water without the aid of enzymes, or a casein selected among those used for gluing stamps and labels, albumin or a fish glue; and
- a completely resoluble and film forming dispersant/stabilizer for vinyl resins, in a concentration between 1 and 40%, more preferably between 1 and 20%, most preferably between 1 and 12%, for example a polyvinyl alcohol, in particular with a weight average molecular weight (hereinafter with the expression "molecular weight" we will intend the weight average molecular weight) of a medium/low value (between 31000 and 124000) and with a hydrolysis rate less than 90%, in particular a polyvinyl alcohol with a molecular weight between 85000 and 124000 and a hydrolysis rate between 87 and 89% has been used; water-soluble compounds derived from cellulose or more generally surfactants or a polyvinylpirrolidone can be alternatively used.

In addition, the mixture can include a raw material that becomes adhesive when soaked (hereinafter called adhesion promoter) aimed at ensuring the stickness of the layer after it has been wetted, which is utilised in a percentage between 3 and 80%, more preferably between 5 and 50%, even more preferably between 10 and 40%, and it may be a natural or synthetic polymer, such as for example: vinyl acetate, in particular with a glass transition temperature of 35° C.

The (vinyl) polymer/copolymer is used to improve the printing resolution in view of its affinity with the solvent contained in the ink and it can be replaced for example by chlorinated or fluorinated vinyl copolymers, or with ethylene-styrene copolymer.

The adhesion promoter, such as polyvinyl acetate, becomes an adhesive when soaked and during the application of the transferable product it allows adhesion to the substrate, thereby avoiding the risk that the transferable product is moved due to the effect of the application tool.

The dispersant for the organic material, i.e. the polyvinyl alcohol with medium-low molecular weight and with low hydrolysis rate, in the first place, due to its surfactant behaviour, contributes to correctly dispersing the vinyl polymer in water and then, in the application stage, to dragging its molecules into the substrate. In the second place, it allows to obtain a resoluble coating, due to the alternation of its chains with those of the vinyl copolymer in the coating structure.

The raw material that becomes adhesive when it is wetted and is completely soluble without leaving residuals, for example a polysaccharide, is used to regulate the solubility of the coating without altering its property to become sticky when moistened.

Figure 2:
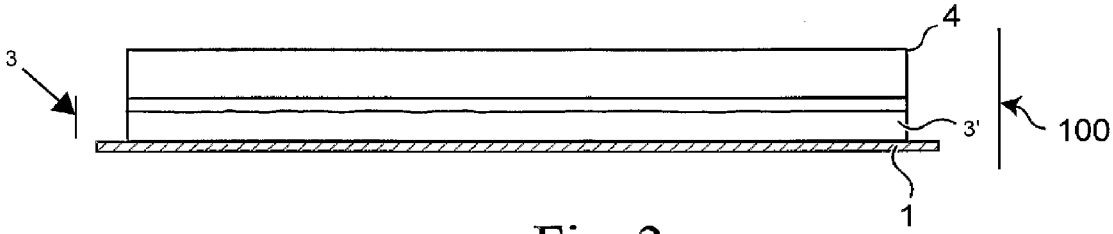
FIG. 2 shows a second preferred embodiment of the product in accordance with this invention.

In particular, it is used to make the finished product compatible with many kinds of supports, since its concentration is effectively a key parameter to increase the solubility of the carrier. With reference to the FIG. 2, the polymeric coating may also be "layered".

In order to get an immediate separation of the support of said transferable product after the application, a polymeric coating has been made comprising two different layers, the release layer 3 and the above described printable layer 4.

This solution is preferred, because the different compositions of the two layers allow a faster water solubilization of the release layer 3.

After the product has been wet applied and is again dry, this solution allows to dampen the product to remove the support 1 and a portion of the release layer 3 before the absorbed printable layer 4 is solved because of soaking, thus avoiding any damage of the layer 4 and consequently of the image printed on the concerned transferable product 100.

The release layer 3, namely the layer 3' nearest to the removable support, is the richest of water soluble compounds. This for instance is preferably composed of

- a completely soluble raw material, adapted not to leave residuals, in a concentration between 5 and 90 percent, preferably between 10 and 85%, even more preferably between 25 and 80%, in particular a polysaccharide water soluble without the aid of enzymes, or a casein selected among those used in glues for stamps and labels, albumin or a fish glue;
- a film-forming water soluble raw material in a concentration between 3 and 50%, even more preferably between 15 and 50%, that can be a natural or synthetic polymer, for example a vinyl acetate, with a glass transition temperature of 35° C.;
- a film-forming and completely re-water-soluble dispersant agent for vinyl resins, in a concentration between 3 and 40%, even more preferably between 5 and 20%, like a polyvinyl alcohol, in particular with medium/low molecular weight (between 31000 and 124000) and with a hydrolysis rate less than 90%, or with molecular weight between 85000 and 124000 uma and a hydrolysis rate between 87 and 89%, or a polyvinylpirrolidone.

Possibly, as far as this layer is concerned, it is possible to add to the mixture: a not-soluble, film forming raw material used for improving the water resistance in this layer, in a concentration between 3 and 20%, more preferably between 6 and 15%, which can be a natural or synthetic polymer, such as for instance: a copolymer between ethylene and vinyl acetate, ethylene and vinyl chloride or other vinyl polymers or copolymers, in particular an ethylene-vinyl acetate with a glass transition temperature of 5° C. (DSC) and an elongation at break of 700% has been successfully used.

It is to be remarked that the mixture of the printable layer and the mixture of the release layer can include the same compounds. In this case, however, it is important to underline that their functions and their concentrations in the layers can be different. As a consequence, even when identical components are utilised the two concerned layers will be different in respect of their functions and their concentrations.

The use of the same raw materials with different functions and different concentrations is very important in the multilayer embodiments of the invention.

In the following Table 1, the solid contents of the components of the printable layer and of the release layer are set forth in connection with two application examples:

TABLE 1

| Component | Printable Layer | Release Layer |
|---|---|---|
| Polyvinyl acetate | 0-40% | 44% |
| Polyvinyl alcohol | 2% | 9% |
| Polyethylene-vinyl acetate | 35% | 0-10% |
| Polysaccharide | 0-35% | 47% |

The present invention also provides for the technology permitting to realise in simple manner the carrier stratification.

To avoid the blending of the two layers during the transferable product production, so as to form a single layer with intermediate properties, it is suggested to apply them in reverse order on a temporary support and to subsequently transfer them to a final support, f.i. to a paper support as described above.

As a matter of fact, the spreading carrier used in the coating process is always water or a solvent which also can maintain the polymers in disperse condition thereby allowing them to be spreadable; therefore, is not possible to directly produce the two layers, otherwise the second layer would be too much blended with the first one.

The described temporary support must have a smooth surface (smooth enough to obtain a low adhesiveness between the carrier and the temporary support), as well as not absorbing and not allowing thermoplastic polymer adhesion, even if it is heated. It can be f.i. a polythene treated paper, coated paper, silicone treated paper or coated and silicone treated paper.

During the production, the mixture having the less soluble solid content is first spread on the above mentioned paper, then the second mixture having the a more soluble solid content is applied. In this manner minimized blending of the layers is assured.

After the second spreading step, the carrier is transferred to the support of the transferable product (in a preferred embodiment of the invention the water-permeable nonwoven fabric) with a heat calender or a wet calender.

The first step of the process consists in coupling by a calender the temporary support with the filter paper by utilising the layered coating as an adhesive. This occurs as a consequence of the plasticity of the coating (heat calendering), or due to partial resolubilisation of the coating obtained by the last spreading step (wet calendering).

When the wet technique is followed, the calender is aligned with the coating machine and its operation takes place by exploiting the residual tackiness of the soluble coating, which is obtained by less than completely drying it (immediately after the first spreading step) with respect to the printable coating.

Subsequently, after calendering or anyway before the image is printed by the user, it is possible to remove the temporary support for re-use. The separation of the support can be carried out by the end user by mechanical removal.

Examples of the various stages during the working cycles for preparation of the transferable products are furnished hereinbelow.

EXAMPLE 1

Preparation of 10000 g of Mixture for Spreading the Release Layer 3000 g of Serigum resoluble AH390 manufactured by Sericol LTD (water based vinyl polymer and polyvinyl alcohol dispersion), 3500 g of Primagum 23-173 manufactured by Sovereign (dispersion of poly-saccharides in a polyvinyl alcohol and water solution) and 3500 g of Planatol XMA-75 manufactured by Planatol GmbH (dispersion of polyvinyl acetate in water and polyvinyl alcohol solution) are poured into a mixer having a capacity greater than 10 l and mixed until a homogeneous paste is obtained. The paste will have a viscosity of about 25000 mPa*s, so that the paste will have to be diluted with water until a viscosity is reached which is adapted to the available spreading technique, as it is well known to those skilled in the art.

To avoid a too high value of surface tension/viscosity ratio which could cause a bad spreading of the mixture, during the coating it is possible to add, after dilution, 1% by weight of a levelling agent, such as the product 3580 from Efka Additives.

When using the screen printing technology, the viscosity value should be between 1000 and 6000 mPa*s, when a Mejer bar coating machine is used, the viscosity should be between 100 and 2500 mPa*s.

When preparing the mixture, other less complex materials can be used in stead of the above mentioned ones. In particular, 3000 g of a 5% by weight of water solution of polyvinyl alcohol as described above, i.e. C523 manufactured by Celanese are prepared. The latter is then mixed with 1500 g of a dispersion of polyvinyl acetate in a polyvinyl alcohol water solution having a 50 percent of solid content and a glass transition temperature of 35° C., such as Vinac 50300 manufactured by Air Products, and 2000 g of dispersion of water soluble polysaccharide in a water solution of a polyvinyl alcohol which has a solid content percentage of 50%, such as Primagum 23-173 manufactured by Sovereign Specialty Chemicals Ltd.

Also in this case, any technician, using water, will be able to dilute the mixture to adjust its viscosity and to use levelling agents should it be necessary for the coating process.

EXAMPLE 2

Preparation of 10000 g of Mixture for Spreading the Printable Layer Coating 7000 g of Serigum resoluble AH390 manufactured by Sericol LTD (water based vinyl polymer and polyvinyl alcohol dispersion), 1500 g of Primagum 23-173 manufactured by Sovereign (dispersion of poly-saccharides in a polyvinyl alcohol and water solution) and 1500 g of Planatol XMA-75 (dispersion of polyvinyl acetate in water and polyvinyl alcohol solution) are poured into a mixer having a capacity greater than 10 l and mixed until a homogeneous paste is obtained.

The paste will have a viscosity of about 15000 mPa*s, so that the paste will have to be diluted with water until a viscosity is reached which is adapted to the available spreading technique.

To avoid a too high value of surface tension/viscosity ratio which could cause a bad spreading of the mixture, during the coating it is possible to add, after dilution, 1% by weight of a leveling agent, such as the product 3580 from Efka Additives.

In this Example, when using the screen printing technology, the viscosity should be between 1000 and 6000 mPa*s, when a Mejer bar coating machine is used, the viscosity should be between 100 and 2500 mPa*s.

Also in this case, when preparing the mixture other less complex raw materials can be used in stead of the above mentioned commercially available ones. In particular, 1000 g of a 5% by weight water solution of polyvinyl alcohol having properties as described above, f.i. C523 manufactured by Celanese are prepared. The latter is then mixed with 1500 g of a dispersion of polyvinyl acetate in a polyvinyl alcohol and water solution having a 50 percent of solid content and a glass transition temperature of 35° C., such as Vinac 50300 manufactured by Air Products, and 1500 g of dispersion of ethylene-vinyl acetate in a water and polyvinyl alcohol solution which has a solid content percentage of 50% and a glass transition temperature of 5° C., such as Airflex EP400 manufactured by Air Products and 1500 g of Primagum 23-173 manufactured by Sovereign.

Also in this case, any technician, by using water, will be able to dilute the mixture for adjusting its viscosity and to use levelling agents for the coating process.

EXAMPLE 3

Coating of the Temporary Support

In the case of screen printing technology, assuming to have diluted the mixture up to 25-30% in solid content, it is possible to use a screen with fabric number between 62 and 77 to spread the mixture of the printable layer, in order to obtain a dry coating of 8-10 g/m$^2$.

The polythene coated paper sheets will be dried in an hot-air oven, setting the temperature to a value that will not damage the temporary support. In this example, the temperature is 60° C.

The next step is to apply another coating, directly on the previous one, by using the mixture for the release layer. In this operation it is possible to use a screen with fabric number between 62 and 77, thereby obtaining a further dry coating of about 8-10 g/m$^2$.

After the sheets have been dried in an oven with the same temperature used for the first coating, the product spreading step on the temporary support is completed.

EXAMPLE 4

Transfer (Inversion) of the Carrier from the Polythene Coated Paper to the Nonwoven Fabric (Final Support)

The polythene coated paper will be coupled to the nonwoven fabric by a calender, by using the release layer as an adhesive.

The calender will be set at a temperature ranging from 90 to 150° C. (this range depends on the composition of the coating and on the calender cylinder speed), at a pressure value of 3 bar and a cylinder tangential speed of approximately of 1-2 m/min.

The temporary support, namely the polythene coated paper, will be removed after the temperature of product of the previous step reaches room temperature or before the printing step carried out by the user.

The result will be a transferable product consisting in a nonwoven fabric bearing two coating layers on its surface; the polythene coated paper can be re-used in the subsequent production cycles.

The possibility to use the solvent based ink plotter for printing the images is an important feature of this invention, since, as a matter of fact, this kind of ink is made of pigments with a characteristic particle diameter of 0.1 μm, while the particle size of the powder toner is about 3 μm. This implies a better print definition and a better penetration of the pigment in the substrate to be decorated.

Some advantages of the product/system according to this invention are:

- excellent print definition by using a solvent based ink plotter,
- easy application on walls,
- a support with a high degree of water-permeability,
- the carrier is designed to be gradually solubilized, thereby promoting its absorption in the substrate without loss of print definition,
- the possibility to permanently fix the ink's pigments and the carrier on the substrate,
- the resistance to moisture, abrasion, water, and light as well as to a certain number of solvents.

The preferred embodiments of the invention and some of its variations have been hereinabove described, but it should be understood that those skilled in the art can make modifications or changes therein without departing from the scope of this invention as defined by the following claims.

The invention claimed is:

1. A decalcomania product, transferable by a transfer solvent and printable by a solvent based ink plotter, comprising:

a support on which two or more layers are applied:

a layer directly contacting the support, or release layer, comprising:

a polyvinyl alcohol having an average molecular weight ranging from 31000 to 124000 uma, a maximum hydrolysis rate of 90 percent, that is soluble in the transfer solvent and at a first percentage ranging from 5 to 20 percent by weight of the release layer;

an organic raw material which is adhesive if soaked, soluble in said transfer solvent, and at a second percentage ranging from 25 to 80 percent by weight of the release layer, wherein the first percentage and second percentage are selected in such a way that the sum of the first percentage and the second percentage is less than or equal to 100; and a farthest layer from said support, or printable layer, having a solid content that is less soluble in said transfer solvent than the release layer, said printable layer comprising:

a polyvinyl alcohol having an average molecular weight ranging from 31000 to 124000 uma, a maximum hydrolysis rate of 90 percent, that is soluble in the transfer solvent and at a third percentage ranging from 1 to 20 percent by weight of the printable layer;

a polymer or copolymer that is printable by a solvent based ink plotter, has affinity with the solvent contained in the ink and is at a fourth percentage ranging from 25 to 80 percent by weight of the printable layer, said polymer or copolymer that is printable is selected from the group consisting of ethylene vinyl acetate, ethylene vinyl chloride, polyvinyl acetate, copolymers of ethylene with vinyl acetate, copolymers of ethylene with vinyl chloride, copolymers of ethylene with styrene, and chlorinated or fluorinated vinyl copolymers; and an organic raw material which can become an adhesive if soaked, is soluble in said transfer solvent and is at a fifth percentage ranging from 1 to 40 percent by weight of the printable layer, wherein the third percentage, the fourth percentage and the fifth percentage are selected such that the sum of the third percentage, the fourth percentage and the fifth percentage is less than or equal to 100 and at least 15% of the printable layer is soluble in said transfer solvent.

2. A decalcomania product according to claim 1, wherein said fifth percentage ranges from 30 to 40 percent by weight.

3. A decalcomania product according to claim 1, wherein said organic raw material which is an adhesive if soaked is selected from the group consisting of: soluble polysaccharides, soluble polysaccharides that are soluble without the use of enzymes, casein, albumin, and fish glue.

4. A decalcomania product according to claim 1, wherein the release layer further comprises an adhesion promoter at a sixth percentage ranging from 10 to 40 percent by weight of the release layer.

5. A decalcomania product according to claim 4, wherein said adhesion promoter is a polymer.

6. A decalcomania product according to claim 5, wherein said adhesion promoter is a polyvinyl acetate.

7. A decalcomania product according to claim 1, wherein the printable layer further comprises an adhesion promoter at a seventh percentage ranging from 5 to 50 percent by weight of the printable layer.

8. A decalcomania product according to claim 7, wherein said adhesion promoter is a polymer.

9. A decalcomania product according to claim 8, wherein said adhesion promoter is a polyvinyl acetate.

10. A decalcomania product according to claim 1, wherein said transfer solvent is selected from the following group consisting of: water, a mixture of water and alcohol, a mixture of water and acids, alcohols without water, glycols, ester, and ethyl acetate.

11. A decalcomania product according to claim 1, wherein the total thickness of said two or more layers is between 5 and 80 μm.

12. A decalcomania product according to claim 11, wherein the thickness of the printable layer is between 3 and 40 μm and the thickness of the release layer is between 2 and 40 μm.

13. A decalcomania product according to claim 12, wherein the thickness of the printable layer is between 5 and 20 μm and the thickness of the release layer is between 2 and 20 μm.

14. A decalcomania product according to claim 1, wherein said support is made of a material permeable to said transfer solvent but resistant to disaggregation due to soaking.

15. A decalcomania product according to claim 14, wherein said support is made of a material selected in the group consisting of: paper materials, filter paper, silicone coated paper, coated paper, and polythene treated paper.

16. A decalcomania product according to claim 14, wherein said support is built of non-woven fabric (NWF) that is permeable to said transfer solvent.

17. A decalcomania product according to claim 16, wherein said non-woven fabric comprises polyester, cellulose and viscose fibers combined together with a binder fibers.

18. A decalcomania product according to claim 17, wherein said support is made by a non-woven fabric comprising polyester, cellulose and viscose fibers combined together with a binder.

19. A decalcomania product according to claim 16, wherein said support is built of non-woven fabric having a basis weight between 10 and 100 $g/m^2$.

20. A decalcomania product according to claim 19, wherein the basis weight is between 10 and 60 $g/m^2$.

21. A decalcomania product according to claim 1, wherein the release layer also includes polyethylene-vinyl acetate in a percentage between 0 and 10 percent by weight of the release layer.

* * * * *